US009097416B2

(12) United States Patent
Van De Moesdijk et al.

(10) Patent No.: US 9,097,416 B2
(45) Date of Patent: Aug. 4, 2015

(54) MULTI-FUNCTIONAL HEAT SINK FOR LIGHTING PRODUCTS

(75) Inventors: Remco Yuri Van De Moesdijk, Geldrop (NL); Marcus Joannes Van Den Bosch, Shanghai (CN)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 81 days.

(21) Appl. No.: 13/980,074

(22) PCT Filed: Jan. 6, 2012

(86) PCT No.: PCT/IB2012/050075

§ 371 (c)(1), (2), (4) Date: Jul. 17, 2013

(87) PCT Pub. No.: WO2012/098476

PCT Pub. Date: Jul. 26, 2012

(65) Prior Publication Data

US 2013/0301277 A1 Nov. 14, 2013

(30) Foreign Application Priority Data

Jan. 20, 2011 (EP) ..... 11151539

(51) Int. Cl.

| | |
|---|---|
| ***F21V 29/00*** | (2015.01) |
| ***F21V 23/00*** | (2015.01) |
| ***F21K 99/00*** | (2010.01) |
| ***F21V 29/70*** | (2015.01) |
| *F21V 3/00* | (2015.01) |

(Continued)

(52) U.S. Cl.

CPC ..... *F21V 29/22* (2013.01); *F21K 9/1355* (2013.01); *F21K 9/90* (2013.01); *F21V 23/005* (2013.01); *F21V 29/004* (2013.01); *F21V 29/70* (2015.01); *F21V 3/00* (2013.01); *F21V 29/507* (2015.01); *F21Y 2101/02* (2013.01); *Y10T 29/49155* (2015.01)

(58) Field of Classification Search

USPC ..... 362/218, 249.02, 294, 311.02, 373, 362/247, 800

See application file for complete search history.

(56) References Cited

U.S. PATENT DOCUMENTS

| | | | |
|---|---|---|---|
| 7,784,969 | B2 | 8/2010 | Reisenauer et al. |
| 7,802,902 | B2 | 9/2010 | Moss et al. |
| 2003/0063476 | A1 * | 4/2003 | English et al. ..... 362/545 |

(Continued)

FOREIGN PATENT DOCUMENTS

| | | |
|---|---|---|
| EP | 2180233 A1 | 4/2010 |

OTHER PUBLICATIONS

Optimizing PCB Thermal Performance for Cree Xlamp LEDs, Cree, Inc, Durham, NC, pp. 1-17, year 2010.

(Continued)

*Primary Examiner* — Laura Tso
(74) *Attorney, Agent, or Firm* — Yuliya Mathis

(57) ABSTRACT

This invention relates to a lighting device having a light source (102, 103), a light output unit, a drive unit (106*a*) arranged to drive the light source, an electrical connection unit connected with the drive unit and arranged to receive input power, and a heat sink (112), which has been provided with multiple reception portions (115, 116). At least the light source and the drive unit are mounted at a first respectively a second reception portion of the heat sink. The heat sink is a formed sheet structure, which has been formed into a predetermined shape from a sheet shaped heat sink blank.

8 Claims, 4 Drawing Sheets

(51) Int. Cl.
*F21Y 101/02* (2006.01)
*F21V 29/507* (2015.01)

(56) References Cited

U.S. PATENT DOCUMENTS

2009/0135595 A1* 5/2009 Chen ..... 362/235
2009/0294780 A1 12/2009 Chou et al.
2010/0008085 A1 1/2010 Ivey et al.
2010/0096993 A1 4/2010 Ashdown et al.
2010/0133578 A1 6/2010 Pickard
2010/0240158 A1 9/2010 Ter-Hovhannissian
2012/0155088 A1* 6/2012 Spaccasassi et al. .... 362/249.04
2012/0250323 A1* 10/2012 Velu ..... 362/249.02
2012/0287636 A1* 11/2012 Chen ..... 362/249.02

OTHER PUBLICATIONS

Joe Jabionski; "LED Technology Overview", OSRAM, DTE Energy, Opto Semiconductors, Energy Conf. and Exhibition, May 5, 2009, pp. 1-33.

* cited by examiner

MULTI-FUNCTIONAL HEAT SINK FOR LIGHTING PRODUCTS

FIELD OF THE INVENTION

The present invention relates to a lighting device comprising a light source, a light output unit, a drive unit arranged to drive the light source, and an electrical connection unit connected with the drive unit and arranged to receive input power.

BACKGROUND OF THE INVENTION

Light devices which has a high temperature light generator and a drive unit for driving the light source use separate support members for those parts, and electrical interconnections between them. Further heat sinks are arranged to keep the temperatures of the mentioned parts as low as possible in order to increase life time, which is strongly related to the operation temperature. It is problematic to obtain a good heat transfer from the support members to the heat sinks, which typically need electrical insulation combined with thermal conductivity. Generally the prior art solutions are comprised of many different part, making it time consuming and expensive to mount and the parts as such are expensive.

Efforts have been made to at least reduce the number of parts. One example of such a lighting device is a LED lighting device as disclosed in U.S. Pat. No. 7,784,969, where the LED light source and the drive unit are co-mounted in a housing designed to transfer heat to the ambience, i.e. a heat sink. The common heat sink has two adjacent cavities, separated by a centre wall which has a hole in the middle for electrical wiring passage from the drive unit to the light source. The heat sink is generally cylindrical and it is provided with peripheral fins to increase the heat dissipation. The structure of the common heat sink is complex and difficult to adapt to different applications.

SUMMARY OF THE INVENTION

It is an object of the present invention to provide a lighting device that alleviates the above-mentioned drawbacks of the prior art and is less complex and more adaptable.

This object is achieved by a lighting device according to the present invention as defined in claim 1 and by a method of manufacturing a lighting device according to claim 8.

The invention is based on an insight that by using a sheet shaped material as a basis for the heat sink the shaping possibilities are substantially increased in comparison with the prior art as disclosed in U.S. Pat. No. 7,784,969, and thus the adaptability to different applications.

Thus, in accordance with one aspect of the present invention, there is provided a lighting device comprising a light source, a light output unit, a drive unit arranged to drive the light source, an electrical connection unit connected with the drive unit and arranged to receive input power, and a heat sink. The heat sink has been provided with multiple reception portions, wherein at least the light source and the drive unit are mounted at a first respectively a second reception portion of the heat sink. The heat sink is a formed sheet structure, which has been formed into a predetermined shape from a sheet shaped heat sink blank.

According to another aspect of the present invention, there is provided a method of manufacturing a lighting device comprising:

providing a sheet shaped heat sink blank;

preparing a first reception portion of the heat sink blank to receive a light source;

preparing a second reception portion of the heat sink blank to receive a drive unit arranged to drive the light source;

mounting a light source at the first reception portion and a drive unit at the second portion;

forming the heat sink blank into a predetermined heat sink shape; and arranging a light output unit and an electrical connection unit.

By means of providing the heat sink as a formed sheet structure, originating from a sheet shaped heat sink blank, it is possible to simplify the manufacture of the heat sink.

In accordance with an embodiment of the lighting device, the heat sink is made of a sheet metal, and the lighting device comprises a light source support arranged at the first reception portion, which light source support forms a metal core printed circuit board in conjunction with the sheet metal at the first reception portion. This embodiment is advantageous in that the metal core printed circuit board is formed directly on the heat sink.

In accordance with an embodiment of the lighting device, the lighting device further comprises a drive unit support, which forms a metal core printed circuit board in conjunction with the sheet metal at the first reception portion.

In accordance with an embodiment of the lighting device, the first reception portion is tongue shaped. Due to the sheet shaped heat sink blank it is possible to form advanced shapes in a simple way, and since the light source is typically arranged on a surface which extends in a different plane than the rest of the heat sink a tongue shaped portion is easy to form, e.g. bend, into a desired position relative to the rest of the heat sink.

In accordance with an embodiment of the lighting device, the light source is a solid state lighting light source. A solid state lighting (SSL) light source, such as a LED light source or an OLED light source, is preferable to use in the present lighting device.

In accordance with an embodiment of the lighting device, the light output unit is mounted on the heat sink. The heat sink is useful as a support structure for all or several other parts of the lighting device.

In accordance with an embodiment of the lighting device, the lighting device further comprises a socket fitting attached to the heat sink, wherein the electrical connections are connected with the socket fitting. It is possible to form the heat sink such that is fits with a suitable socket fitting, and due to the sheet structure it is easy to provide different shapes suitable for different kinds of socket fittings.

These and other aspects, features, and advantages of the invention will be apparent from and elucidated with reference to the embodiments described hereinafter.

BRIEF DESCRIPTION OF THE DRAWINGS

The invention will now be described in more detail and with reference to the appended drawings in which.

DESCRIPTION OF PREFERRED EMBODIMENTS

Figure 1A:
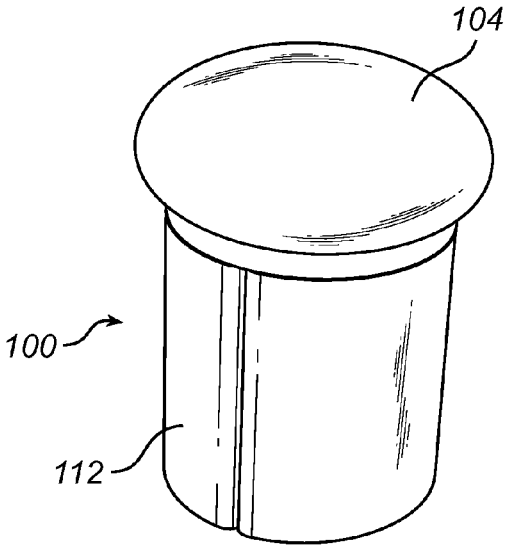
FIG. 1*a* is a schematic perspective view of an embodiment of a lighting device according to the present invention.
Figure 1B:
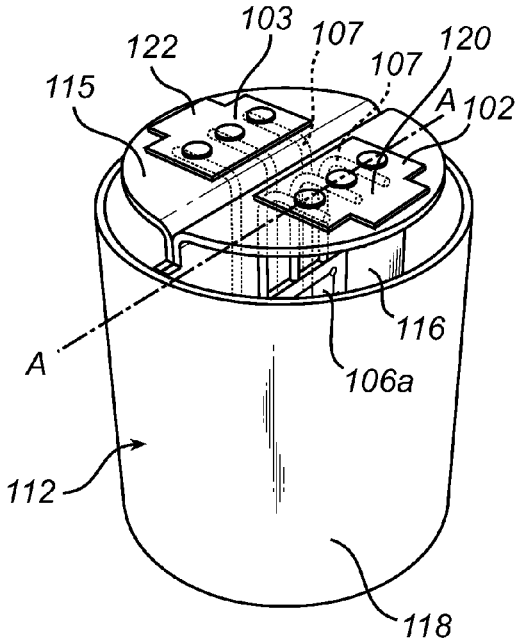
FIGS. 1*b* and 1*c* are respective schematic perspective views from above and below of a part of the lighting device shown in FIG. 1*a;*
Figure 1C:
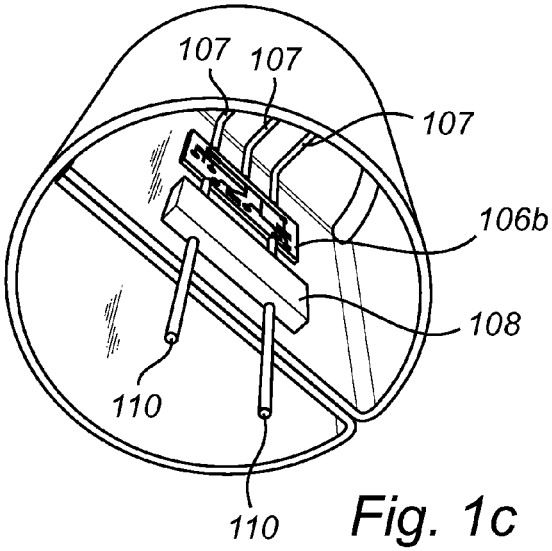

Referring to FIGS. 1*a* to 1*c*, a first embodiment of the lighting device 100 according to the present invention comprises two light sources 102, 103, a light output unit 104, drive units 106*a*, 106*b* interconnected with the light sources 102, 103 via connection wiring 107, an electrical connection unit 108 interconnected with the drive units 106*a*, 106*b* and arranged to receive input power via input terminals 110, and a heat sink 112, which has been provided with multiple reception portions 114, 115, 116, 117. A first and a second reception portion 114, 115 thereof support the respective light sources 102, 103. A third reception portion 116 and a fourth reception portion 117 support the respective drive units 106*a*, 106*b*. The electrical connection unit 108 is mounted on the third reception portion 116. The light output unit 104 encloses the light sources 102, 103 and is arranged to modify the light generated by the light sources into a desired appearance. In this embodiment the light output unit 104 is a diffuser which mixes the light and spreads it into a uniform intensity in different output directions.

Figure 1D:
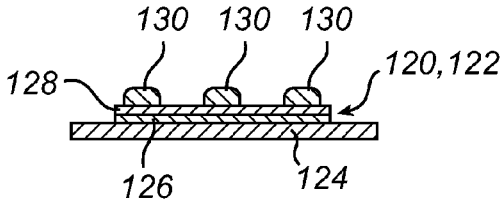
FIG. 1*d* is a cross-sectional view of an enlarged portion of the part of the lighting device shown in FIG. 1*b* taken along the line A-A in FIG. 1*b;*

The heat sink 112 is a formed sheet structure, which has been formed into a predetermined shape from a sheet shaped heat sink blank 500, as shown in FIG. 5. A main portion 118 of the heat sink 112 is cylindrical. The first and second reception portions 114, 115 are tongue shaped and extend perpendicular to the longitudinal axis of the main portion 118 at one end thereof and within the periphery of the main portion 118. At each one of the first and second reception portions, respectively, 114, 115 there is provided a light source support 120, 122, which forms a metal core printed circuit board (MCPCB) in conjunction with the sheet metal at the reception portion 114, 115, as shown in greater detail in FIG. 1*d*. The MCPCB 120, 122 comprises a bottom metal layer, or metal core, 124, which is the reception portion of the heat sink 112, an intermediate layer 126, typically a dielectric layer, which has properties that provide electrical insulation and heat conduction, and a top metal layer 128, typically a copper layer, which is a circuit layer. On top of the top metal layer 128 light emitting elements, such as LEDs 130 are mounted. As alternatives to the MCPCB structure the light source support 120, 122 could comprise for instance an FR4 PCB, a ceramic PCB or a flexible PCB. Furthermore, as an alternative, at least some of the first to fourth reception portions 114-117, depending on the structure of the electric parts, there is no need for an electrically insulating intermediate layer, but merely a good thermal conduction between the electrical part and the heat sink.

Figure 5A:
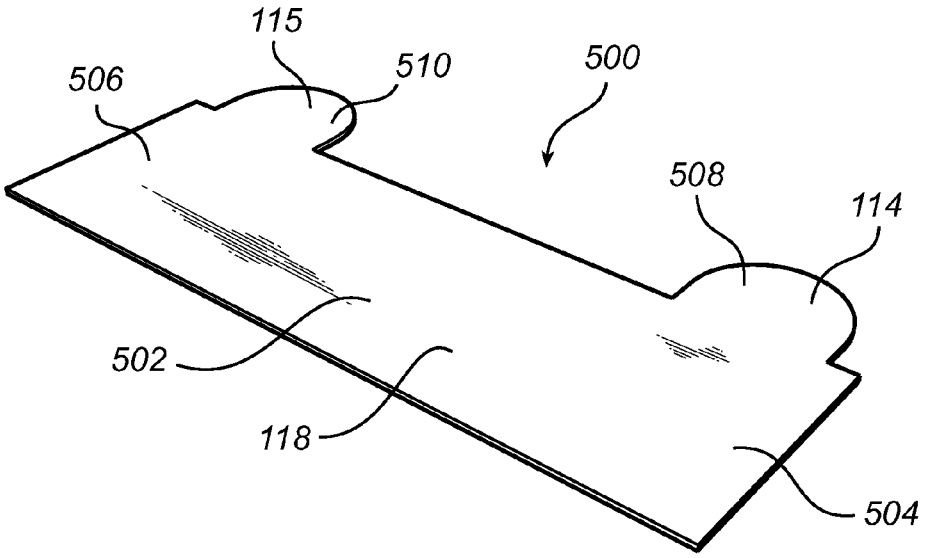
FIGS. 5*a* to 5*c* show a heat sink blank.
Figure 5B:
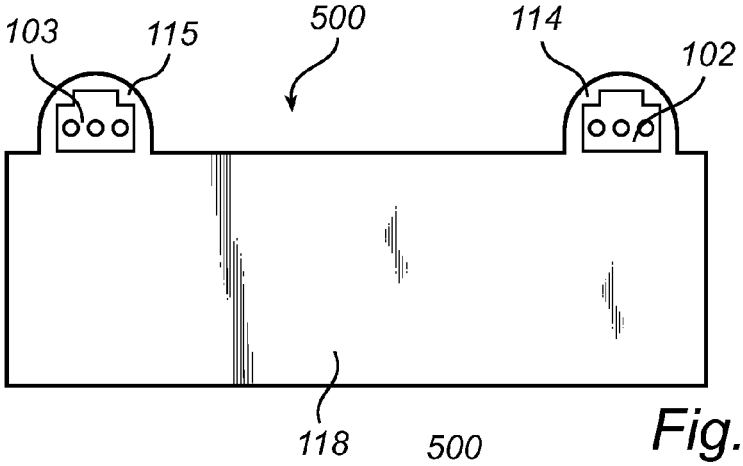
Figure 5C:
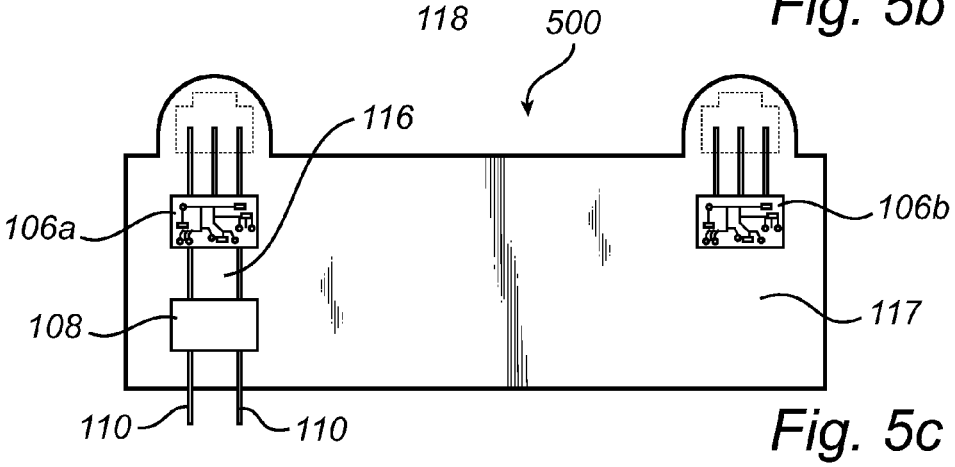

According to an embodiment of the method of manufacturing a lighting device according to the present invention, see FIGS. 5*a*-5*c*, a heat sink blank 500 is cut out of a metal sheet. The sheet has a generally rectangular shape comprising a rectangle section with two tongues 508, 510 protruding from a long side of the rectangle section close to each respective short side thereof, and comprising the first and second reception portions 114, 115 mentioned above. A mid section 502 of the rectangle constitute the main portion 118 mentioned above, and end sections 504, 506 of the rectangle, at each end of the mid section 502, comprise the third and fourth reception portions 116, 117 at the opposite surface of the heat sink blank 500 compared to the first and second reception portions 114, 115. Thus, the tongues 508, 510 protrude from the end sections 504, 506. Next electrical wiring is applied, e.g. printed, on both sides of the sheet 500. Applying the electrical wiring comprise forming the first and second reception portions 114, 115 for the light sources 102, 103 including forming MCPCBs at the tongues 508, 510, on one side of the sheet 500; forming the third and fourth reception portions 116, 117 for the drive units 106*a*, 106*b* including forming MCPCBs at the end sections 504, 506 on the other side of the sheet 500; and forming electrical wiring for connecting the drive units 106*a*, 106*b* with their respective light source 102, 103 via holes through the sheet 500.

Next the blank 500 is formed into the predetermined shape of the heat sink 112 of the lighting device 100 by means of suitable metal forming techniques, such as pressing, bending and rolling. More particularly the end sections 504, 506 are bent at the borders between these sections and the main section 502; the main section 502 is formed into a cylindrical shape, such that the end sections 504, 506 extend within the cylinder along a diameter thereof adjacent to each other, and the tongues 508, 510 are bent in opposite directions until they extend in opposite directions and perpendicular of the end sections 504, 506. Thereby the light sources 102, 103 become located on a top surface of the tongues 508, 510 emitting light away from the heat sink 112.

Thereafter, the light sources 102, 103 are mounted on the respective MCPCB at the first and second reception portions 114, 115, and the drive units 106*a*, 106*b* are mounted on their respective MCPCB at the third and fourth reception portions 116, 117. Additionally, the electrical connection unit 108 is mounted on the fourth reception portion 117, or on the third reception portion 116.

Then the light output unit 104 is mounted at the top of the cylindrical main portion 118 of the heat sink 112, thereby enclosing the light sources 102, 103. Finally, though not shown in FIGS. 1*a*-1*d*, a suitable socket fitting is mounted at the bottom of the cylindrical main portion 118 of the heat sink 112. The electrical connection unit 108 is connected with the socket fitting.

Figure 2:
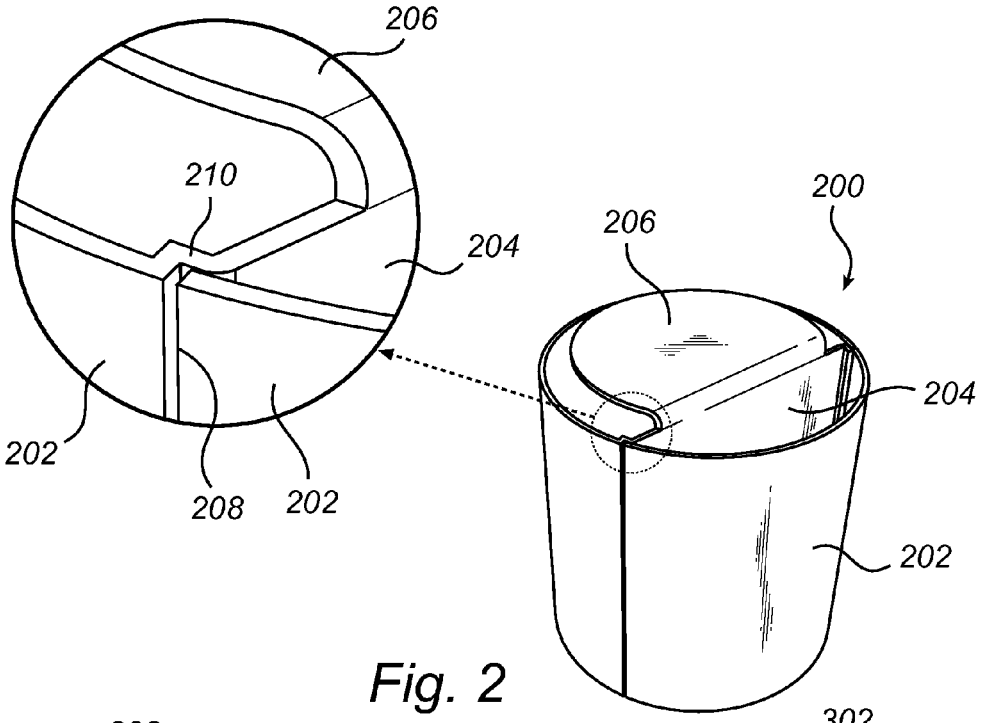
FIG. 2 is a schematic perspective view of a part of another embodiment of the lighting device.

Referring to FIG. 2 a part of a second embodiment of the lighting device is shown. More particularly an alternative shape of the heat sink 200 is shown. In this embodiment as well, the heat sink 200 has a cylindrical main portion 202, which has been formed from a rectangular main section of the heat sink blank, but it has a single end section 204, adjacent to the main portion 202, and a single tongue shaped section 206 protruding from the end section 204. The heat sink 200 has been formed from a blank into a predetermined shape according to similar principles as the heat sink of the first embodiment, such that the end section 204 extends in parallel with a diameter of the cylindrical main portion 202 but at an off-centre position, and such that the tongue 206 extends perpendicular of the end section 204. The tongue 206 has a first reception portion carrying a light source (not shown), and the end section comprises a second reception portion carrying the drive unit and electrical connection unit (not shown). The first and second reception portions have been formed on the same side of the heat sink blank. As shown in an enlarged part of FIG. 2, an end 208 of the main portion 202, opposite to the end section 204, is received in a stepped seat 210 formed at a border between the end section 204 and the main portion 202 for providing a smooth outer surface of the cylindrical main portion 202. Additionally, the seam between the end 208 of the main portion 202 and the stepped seat 210 can be covered by means of a filling material or a coating. The same applies to the corresponding seam of the first embodiment described above.

Figure 3A:
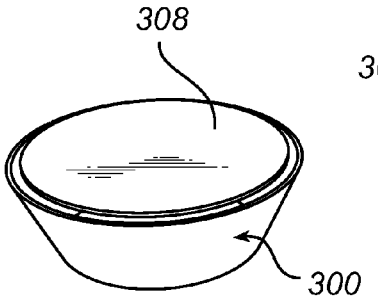
FIGS. 3*a* to 3*c* are schematic perspective views of parts of another embodiment of the lighting device.
Figure 3B:
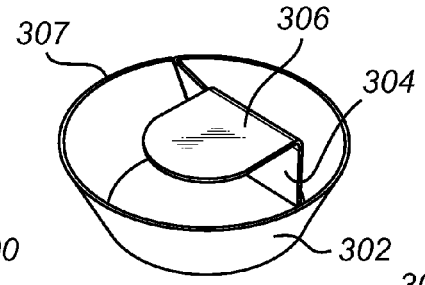
Figure 3C:
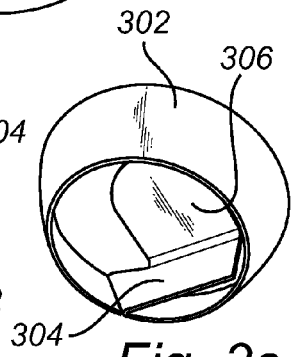

According to a third embodiment of the lighting device, as shown in FIGS. 3*a*-3*c*, the main portion 302 of the heat sink 300 is funnel shaped. Like in the second embodiment, an end section 304 of the heat sink 300 extends in parallel with a diameter of the main portion 302 but off-centered, and it comprises a tongue 306 extending perpendicular of the end section 304 at an upper, larger mouth 307 of the main portion 302. The tongue 306 carries the light source (not shown) emitting light away from the heat sink 300 through a planar light output unit 308 covering the upper mouth 307.

Figure 4A:
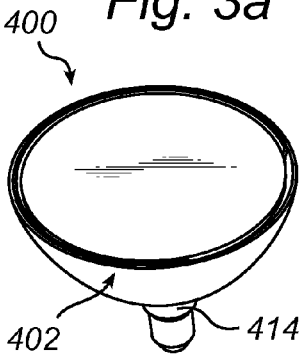
FIG. 4*a* is a schematic perspective view of another embodiment of the lighting device.
Figure 4B:
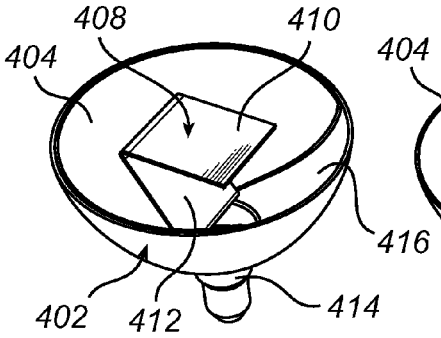
FIGS. 4*b* to 4*c* are schematic perspective views of parts of the embodiment shown in FIG. 4*a*.
Figure 4C:
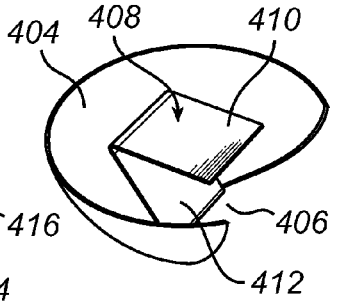

According to a fourth embodiment of the lighting device 400, as shown in FIGS. 4*a*-4*c*, the heat sink 402 is generally dome shaped. The heat sink 402 comprises a dome shaped main section 404 which has a gap 406 in the wall, and an end section 408, which has been bent into a support structure for the light source and the other electrical units. The end section 408 has a tongue shaped first reception portion 410 extending perpendicularly of a centre axis of the main section 404, for receiving the light source, and a second reception portion 412 extending obliquely to the centre axis from an inner end of the dome towards the mouth thereof. The lighting device further comprises a socket fitting 414, which has a dome sector portion 416 filling the gap 406. By having the socket fitting 414 constituting a portion of the dome the forming of the heat sink 402 is facilitated.

Figure 6:
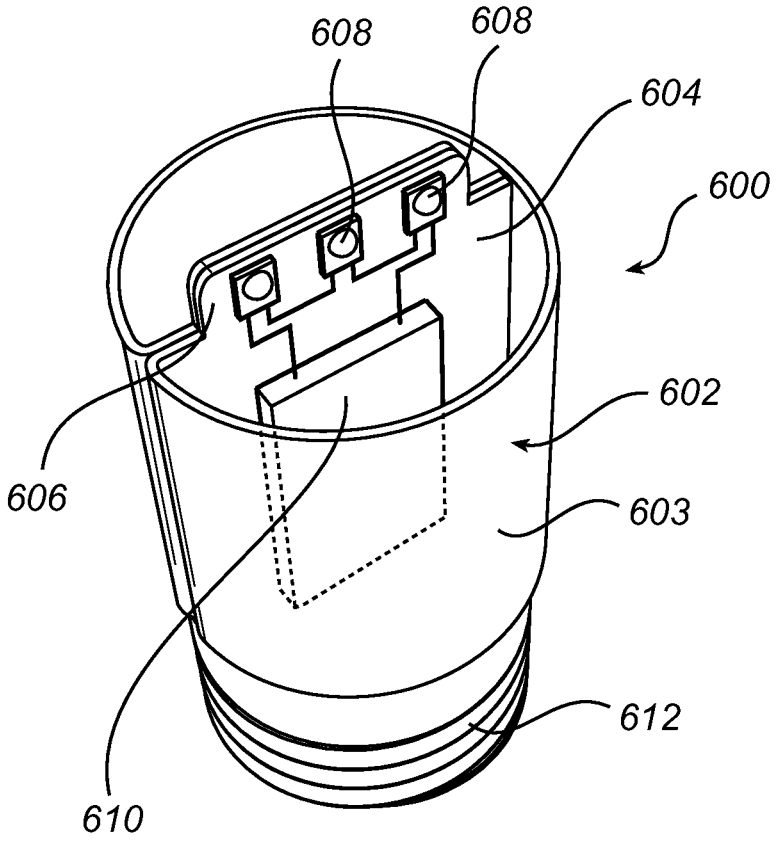
FIG. 6 is a schematic perspective view of a further embodiment

According to a fifth embodiment of the lighting device 600, as shown in FIG. 6, the heat sink 602 has been formed into a substantially cylindrically shaped housing, having a cylindrical portion 603, and plate shaped portions, which have been bent inwards of the cylindrical portion 603, and which extend in parallel and adjacent to each other across the inner space of the cylindrical portion 603. Each one of the plate shaped portions comprises adjacent reception portions 604, 606 located on the same side of the plate shaped portion. A light source comprising light emitting elements 608, and a drive/electrical connection unit 610 are arranged on the respective reception portions 606, 604 in a single side arrangement. A first reception portion 606 of the reception portions 604, 606 is a tongue protruding from the second reception portion 604, and, consequently, the light emitting elements 608 carried by the first reception portion 606 are mounted in a plane which is parallel with a centre axis of the cylindrical portion 603. Thus, they can be regarded as vertically mounted while the light emitting elements 130 of the first embodiment are horizontally mounted. Since light emitting elements 608 are arranged on opposite reception portions thus facing opposite directions an advantageous light distribution is obtained, in particular when covered by an appropriately light shaping light output unit. At a rear end of the lighting device 600 there is provided a socket fitting 612. In this embodiment, the heat sink 602 as a whole is an MCPCB, thus integrating the light sources and the housing. Alternatively, the reception portions can be arranged with separate MCPCBs as described in conjunction with above embodiments.

Above, embodiments of the lighting device and method of manufacturing a lighting device according to the present invention as defined in the appended claims have been described. These should be seen as merely non-limiting examples. As understood by a skilled person, many modifications and alternative embodiments are possible within the scope of the invention.

It is to be noted, that for the purposes of this application, and in particular with regard to the appended claims, the word "comprising" does not exclude other elements or steps, that the word "a" or "an", does not exclude a plurality, which per se will be apparent to a person skilled in the art.

The invention claimed is:

1. A lighting device comprising a light source, a light output unit, a drive unit arranged to drive the light source, an electrical connection unit connected with the drive unit and arranged to receive input power, and a heat sink, comprising multiple reception portions, wherein at least the light source and the drive unit are mounted at a first reception portion and a second reception portion of the heat sink, respectively, wherein the heat sink is a formed sheet structure, which has been formed into a predetermined shape from a sheet shaped heat sink blank, wherein the first reception portion is tongue shaped.

2. A lighting device comprising a light source, a light output unit, a drive unit arranged to drive the light source, an electrical connection unit connected with the drive unit and arranged to receive input power, and a heat sink, comprising multiple reception portions, wherein at least the light source and the drive unit are mounted at a first reception portion and a second reception portion of the heat sink, respectively, wherein the heat sink is a formed sheet structure, which has been formed into a predetermined shape from a sheet shaped heat sink blank, wherein the first reception portion is tongue shaped, wherein the heat sink is made of a sheet metal, and wherein the lighting device comprises a light source support arranged at the first reception portion, which light source support forms a metal core printed circuit board in conjunction with the sheet metal at the first reception portion.

3. The lighting device according to claim 2, wherein the lighting device further comprises a drive unit support, which forms a metal core printed circuit board in conjunction with the sheet metal at the third reception portion.

4. The lighting device according to claim 2, wherein the light source is a solid state light source.

5. The lighting device according to claim 2, wherein the light output unit is mounted on the heat sink.

6. The lighting device according to claim 2, wherein the lighting device further comprises a socket fitting attached to the heat sink, wherein the electrical connections are connected with the socket fitting.

7. A method of manufacturing a lighting device comprising providing a sheet shaped heat sink blank;

preparing a first reception portion of the heat sink blank to receive a light source;

preparing a second reception portion of the heat sink blank to receive a drive unit arranged to drive the light source;

forming the heat sink blank into a predetermined heat sink shape;

mounting a light source at the first reception portion and a drive unit at the second portion; and arranging a light output unit and an electrical connection unit; wherein said forming the heat sink blank into a predetermined heat sink shape comprises forming the first reception portion thereof as a tongue;

wherein the heat sink blank is a sheet metal, and wherein said preparing a first portion comprises applying a heat conducting electrically insulating layer on the heat sink blank, and applying an electrically conducting layer on the electrically insulating layer to form a metal core printed circuit board.

8. The method according to claim 7, wherein said forming the heat sink blank into a predetermined heat sink shape comprises forming a portion thereof into a cylindrical portion.

* * * * *